US006480078B2

(12) United States Patent
Kim et al.

(10) Patent No.: US 6,480,078 B2
(45) Date of Patent: Nov. 12, 2002

(54) RESONATING APPARATUS IN A DIELECTRIC SUBSTRATE

(75) Inventors: Bumman Kim, Pohang-shi (KR); Junyoul Lim, Pohang-shi (KR); Seonghan Ryu, Pohang-shi (KR); Joung Hyun Yim, Pohang-shi (KR)

(73) Assignee: Postech Foundation, Kyungsangbuk-Do (KR)

( * ) Notice: Subject to any disclaimer, the term of this patent is extended or adjusted under 35 U.S.C. 154(b) by 0 days.

(21) Appl. No.: 09/931,930

(22) Filed: Aug. 20, 2001

(65) Prior Publication Data

US 2002/0036554 A1 Mar. 28, 2002

(30) Foreign Application Priority Data

Aug. 18, 2000 (KR) ..... 2000-47786

(51) Int. Cl.[7] ..... H01P 7/10

(52) U.S. Cl. ..... 333/219.1; 333/219.2; 333/202; 333/204

(58) Field of Search ..... 333/219.1, 219.2, 333/202, 204; 324/637, 638, 639

(56) References Cited

U.S. PATENT DOCUMENTS 4,547,754 A * 10/1985 Murakami et al. ..... 333/204
4,755,780 A * 7/1988 Ito et al. ..... 333/219.2
4,774,483 A * 9/1988 Miccoli et al. ..... 333/202
4,983,937 A * 1/1991 Kinoshita et al. ..... 333/202
5,334,941 A * 8/1994 King ..... 324/637
6,016,090 A * 1/2000 Iio et al. ..... 331/107 DP
6,127,907 A * 10/2000 Furuya et al. ..... 257/528

* cited by examiner

*Primary Examiner*—Michael Tokar
*Assistant Examiner*—Linh Van Nguyen
(74) *Attorney, Agent, or Firm*—Bacon & Thomas

(57) ABSTRACT

A resonating apparatus includes a dielectric resonator on a dielectric supporting substrate, a fluid dielectric membrane which overspreads the dielectric resonator, and a microstrip line which is arranged in the fluid substrate membrane so that it is coupled with the dielectric resonator. The resonating apparatus reduces the conductivity loss by lengthening the distance between the dielectric supporting substrate in the higher layer and the microstrip line in the lower layer when it is used in a multi-layer circuit such as an MMIC. Further, the resonating apparatus increases the dielectric permittivity by using the dielectric resonator which has high dielectric permittivity as well as the fluid dielectric membrane. In this way, the resonating apparatus obtains high Q.

9 Claims, 9 Drawing Sheets

RESONATING APPARATUS IN A DIELECTRIC SUBSTRATE

FIELD OF THE INVENTION

The present invention relates to a resonating apparatus in a dielectric substrate; and, more particularly, to a dielectric substrate resonator, which has a three-dimensional structure for coupling with a microstrip line, for obtaining high Q by reducing dielectric loss and conductivity loss.

BACKGROUND OF THE INVENTION

Recently, there is an increasing demand for communication systems using microwaves in the mobile and satellite communication fields. It is also a trend in the information communication field that devices are downsized and the communication frequency band moved to a higher frequency band. In personal mobile communication systems such as PCS, satellite communication, or satellite broadcasting, a GHz frequency band is used for communication.

An important component of equipment using the high frequency band is the microwave dielectric device, which has been widely developed to be used as a dielectric resonating filter. By microwave is meant frequencies ranging from 300 MHz to 300 GHz.

FIG. 1 illustrates a structure for coupling a microstrip line 12 with a dielectric resonator 14 adhered to a substrate. A dielectric resonator in accordance with the prior art, as shown in FIG. 1, is generally used in multi-layer circuits such as monolithic microwave integrated circuits (MMICs) due to its simple structure.

The dielectric resonator 14 in accordance with the prior art is adhered to an upper side of a dielectric substrate 10, which is made of GaAs. The microstrip line 12, which is separated horizontally from the dielectric resonator 14, is arranged on the upper side of the dielectric substrate 10. When the length of the microstrip line 12 is ½ λ, where λ is the wavelength of the microwave, and when the microstrip line 12 and the dielectric substrate 10 are composed of gold and GaAs respectively, the Q of the microstrip line 12 is calculated by Equation (1).

$$Q_u = \frac{\beta}{2(\alpha_c + \alpha_d)} = 66.8 \qquad \text{Equation (1)}$$

where β is a propagation constant, $\alpha_c$ is an attenuation due to conductivity loss and $\alpha_d$ is the attenuation due to dielectric loss.

$\alpha_c$ and $\alpha_d$ in Equation (1) are calculated by Equations (2) and (3), respectively.

$$\alpha_c = \frac{R_s}{Z_0 W} \qquad \text{Equation (2)}$$

where $R_s$, $Z_0$ and W are a surface resistance, a characterization impedance and a width of the microstrip line 12, respectively.

$$\alpha_d = \frac{k_0 \varepsilon_r (\varepsilon_e - 1)\tan\delta}{2\sqrt{\varepsilon_e}\,(\varepsilon_r - 1)} \qquad \text{Equation (3)}$$

where $\epsilon_r$ is a relative dielectric permittivity, $\epsilon_e$ is an effective dielectric permittivity and tanδ is a loss tangent of the dielectric substrate.

Referring to Equations (1) to (3) , when $Z_0$ is 50Ω, tanδ is 0.0006 and the resonant frequency is 10 GHz. The Q of the microstrip line is about 66.

According to Equation (1), the Q of the dielectric resonator 14 depends on two factors, $\alpha_c$ and $\alpha_d$, wherein $\alpha_c$ is inversely proportional to $Z_0$ and W. When the dielectric resonator 14 of the prior art is applied to a multiplayer circuit, a fluid dielectric substance is used to configure a microstrip line. In general, the height of the fluid dielectric substance, e.g., BCB, is limited to 40 μm. The smaller the height of the fluid dielectric substance, the narrower the width of the microstrip line. Therefore, Q becomes smaller.

Further, the conductivity loss of the microstrip line 12 affects the energy loss of the dielectric resonator 14. Accordingly, the dielectric resonating device in accordance with the prior art is not suitable for obtaining the high Q required in microwave applications.

SUMMARY OF THE INVENTION

It is therefore an object of the present invention to provide a resonating apparatus that is suitable for use in microwave including multi-layer circuits such as MMICs that require high integrity and high Q.

In accordance with the present invention, there is provided a resonating apparatus comprising: a dielectric supporting substrate; a dielectric resonator which is formed on the dielectric supporting substrate; a fluid dielectric membrane which overspreads the dielectric resonator; and a microstrip line which is arranged in the fluid substrate membrane so that it is coupled with the dielectric resonator.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

In the following, referring to the accompanying drawings, preferred embodiments in accordance with the present invention will be described in detail.

Figure 1:
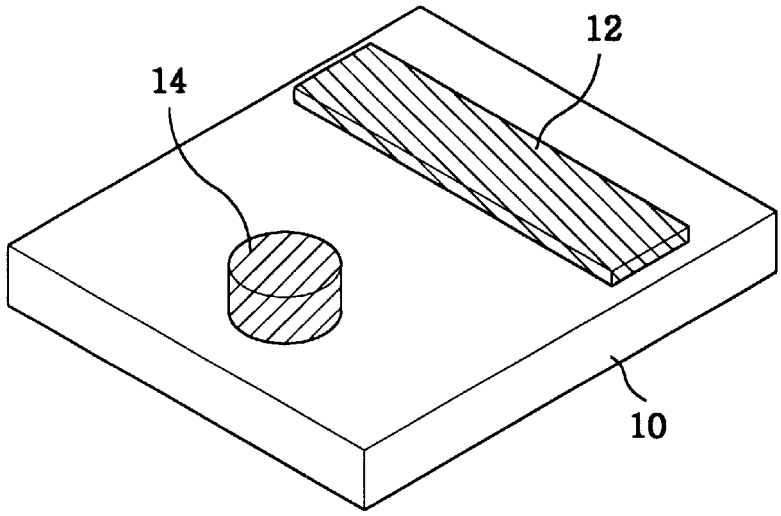
FIG. 1 (PRIOR ART)
FIG. 1 illustrates a perspective view of a dielectric resonator in accordance with the prior art.
Figure 2:
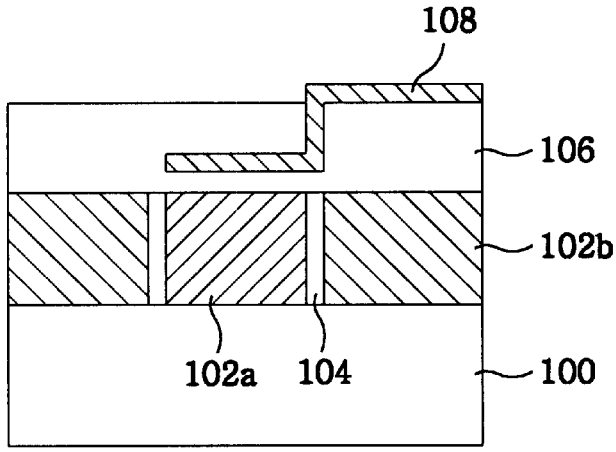
FIG. 2 illustrates a vertical cross-sectional view of a dielectric substrate resonator in accordance with an embodiment of the present invention.

FIG. 2 illustrates a vertical cross-sectional view of a dielectric substrate resonator in accordance with an embodiment of the present invention.

As shown in FIG. 2, the dielectric substrate resonator in accordance with the embodiment of the present invention comprises a dielectric supporting substrate 100, a dielectric resonator 102*a*, a dielectric resonator substrate 102*b*, a fluid dielectric membrane 106 and a microstrip line 108.

In the dielectric substrate resonator shown in FIG. 2, the dielectric resonator 102*a* is formed on the dielectric supporting substrate 100, and the dielectric resonator 102*a* is composed of a material of higher dielectric permittivity than those of the dielectric supporting substrate 100 and the fluid dielectric membrane 106. For example, Teflon, GaAs and polymide can be used as materials of the dielectric supporting substrate 100, the dielectric resonator 102*a*, and the fluid dielectric membrane 106, respectively.

The dielectric resonator substrate 102*b*, which is also formed on the dielectric supporting substrate 100, is composed of the same material as the dielectric resonator 102*a*. In the embodiment of the present invention, the dielectric resonator substrate 102*b* surrounds the dielectric resonator 102*a* with a gap 104 therebetween. The gap 104 is filled with air whose dielectric permittivity is 1.

The fluid dielectric membrane 106 overspreads upper sides of the dielectric resonator 102*a*, the dielectric resonator substrate 102*b* and the gap 104 therebetween.

Further, the microstrip line 108, which is composed of conductive material, is arranged in the fluid dielectric membrane 106 so that it is coupled with the dielectric resonator 102*a*.

In order to reduce the conductivity loss in the microstrip line 108, the dielectric substrate resonator in accordance with the present invention further includes a ground line in each of the fluid dielectric membrane 106 and the dielectric supporting substrate 100.

Figure 3:
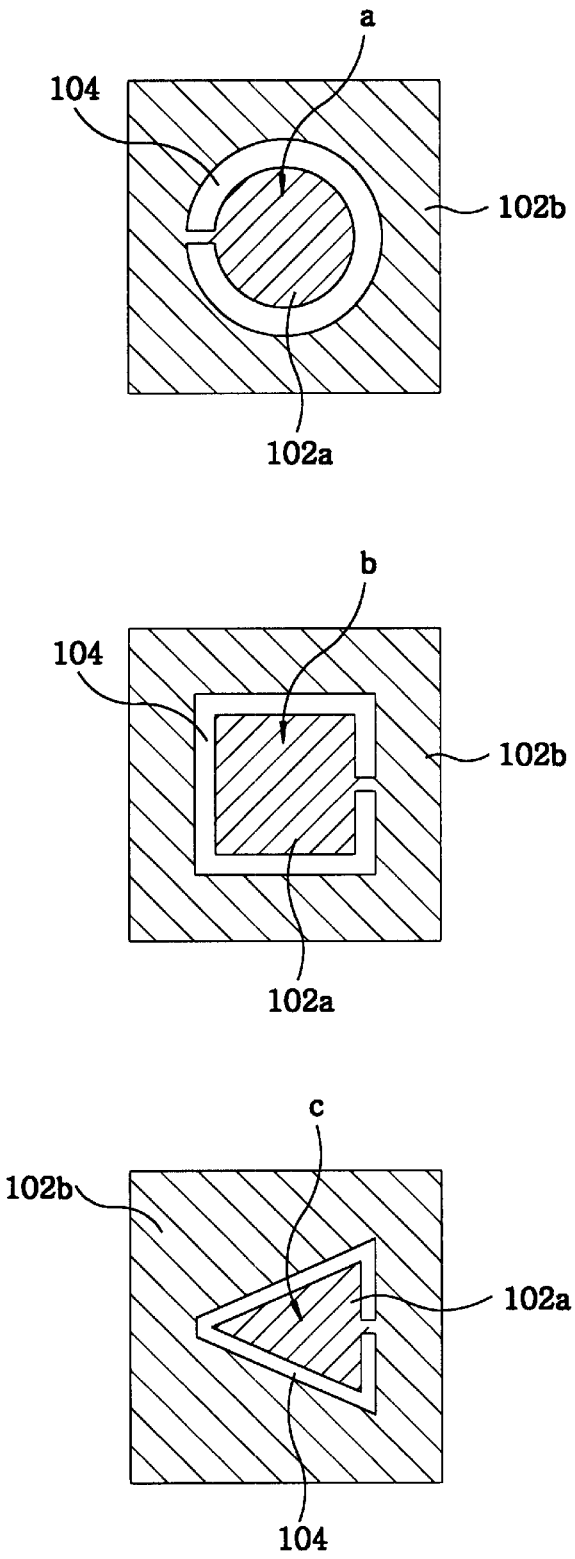
FIG. 3 depicts horizontal cross-sectional views of dielectric substrate resonators of various shapes, in accordance with the present invention.

FIG. 3 illustrates horizontal cross-sectional views of dielectric substrate resonators, each of which has a different shape from each other, in accordance with the present invention. Referring to FIG. 3, the cross-sectional shape of the dielectric resonator 102*a* can be a circle (a), a rectangle (b) or a triangle (c). However, the shape can also be any other polygonal shape.

Figure 4:
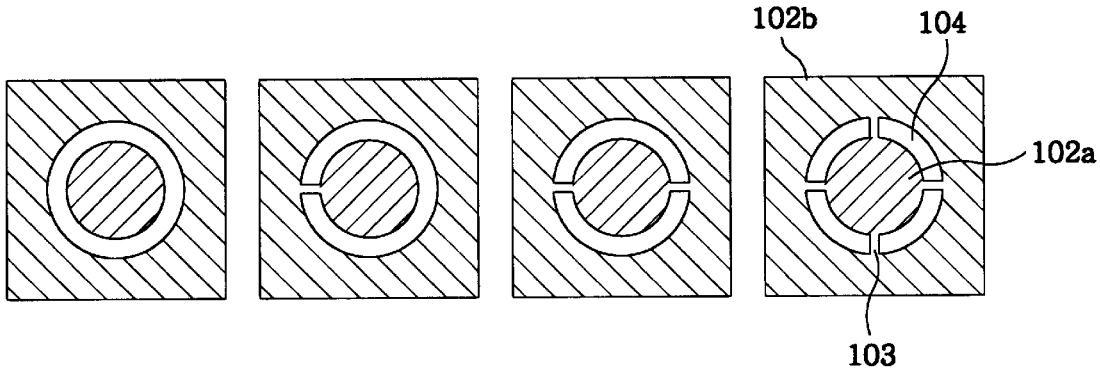
FIG. 4 depicts horizontal cross-sectional views of dielectric substrate resonators, which have connection lines to dielectric resonator substrates in accordance with the present invention.

FIG. 4 shows horizontal cross-sectional views of dielectric resonators with dielectric resonator substrates in accordance with the present invention.

As shown in the first drawing of FIG. 4, the dielectric resonator 102*a* is formed by aquatinting the dielectric resonator substrate 102*b*, which is composed of GaAs, so that a gap 104 is formed therebetween.

Also, as shown in other drawings of FIG. 4, a connection line 103 can be formed between the dielectric resonator 102*a* and the dielectric resonator substrate 102*b*. The connection line 103 can be formed by aquatinting the dielectric resonator substrate 102*b* so that the gap 104 is formed in the shape of ring except the part of the connection line 103. In this case, the number of the connection lines 103 is at least more than one, and preferably the number and the position thereof are determined so that the dielectric resonator 102*a* and the dielectric resonator substrate 102*b* are connected to each other in a stable state. Further, it is preferable that the number and the position of the connection lines 103 are adjusted according to environmental factors such as the solidity of the substrate.

Figure 5:
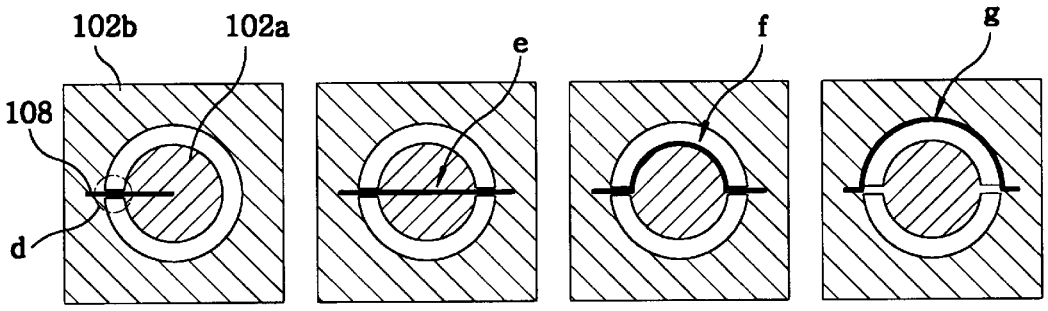
FIG. 5 exhibits horizontal cross-sectional views of various structures for coupling dielectric resonators with microstrip lines in accordance with the present invention.

FIG. 5 exhibits horizontal cross-sectional views of various structures for coupling dielectric resonators with microstrip lines in accordance with the present invention.

Referring to FIG. 5, the microstrip line 108 is formed in the shape of a straight line or a semicircle. When the microstrip line 108 has the shape of a straight line, it can be extended near to the center of the dielectric resonator 102*a* (d) or pass through the center thereof (e). When the microstrip line 108 has the shape of a semicircle, it can be arranged following the inscribed circle (f) or the circumference of the dielectric resonator 102*a*. In this way, the microstrip line 108 can obtain different degrees of coupling with the dielectric resonator 102*a* by changing the shape and the position thereof.

Figure 6A:
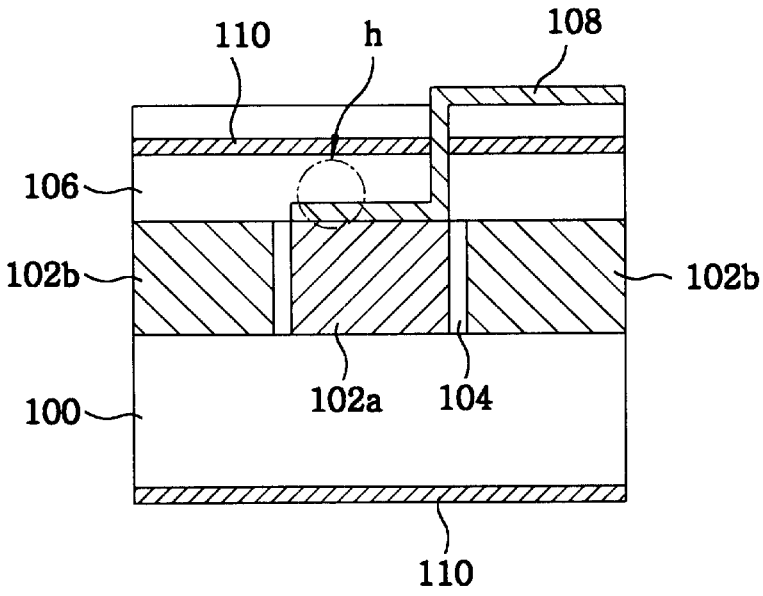
FIG. 6A exhibits a vertical cross-sectional view of a structure for coupling a dielectric resonator with a microstrip line in accordance with an embodiment of the present invention.
Figure 6B:
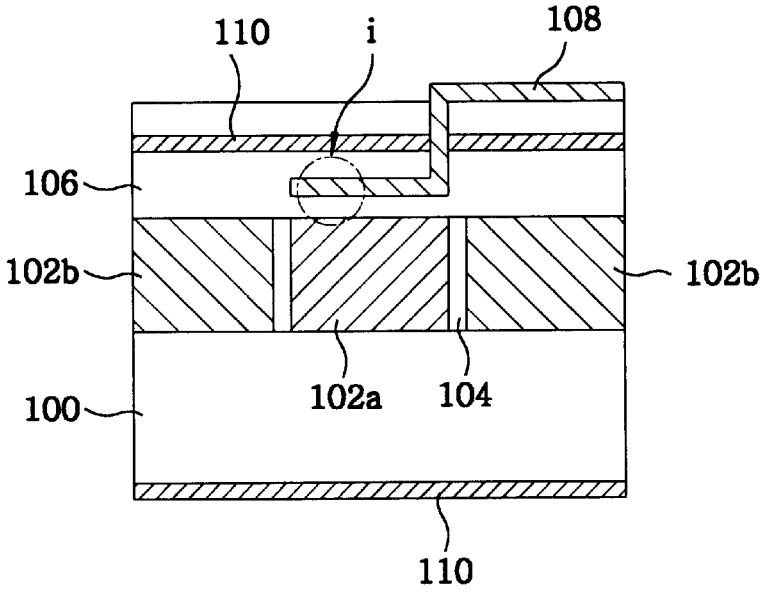
FIG. 6B charts a vertical cross-sectional view of a structure for coupling a dielectric resonator with a microstrip line in accordance with another embodiment of the present invention.

FIGS. 6A and 6B show vertical cross-sectional views of structures for coupling of dielectric resonators with microstrip lines.

As illustrated in FIG. 6A, in order to increase the degree of coupling, the microstrip line 108 is arranged on the upper side of the dielectric resonator 102*a* so that the microstrip line 108 and dielectric resonator 102*a* come into contact with each other. Alternatively, the microstrip line 108 may be formed in a position separated from the upper side of the dielectric resonator 102*a* to lower the degree of coupling as shown in FIG. 6B. In this way, the degree of coupling thereof can be adjusted. The dielectric substrate resonator in accordance with the present invention is surrounded by a ground plane 110.

Figure 7:
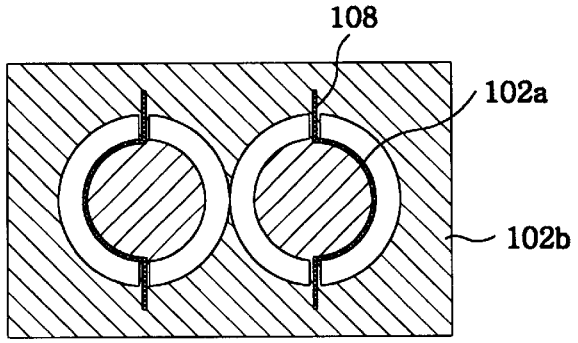
FIG. 7 illustrates a horizontal cross-sectional view of a filter that is constructed by using dielectric resonators in accordance with the present invention.

FIG. 7 exemplifies a band-pass filter which is constructed by combining two dielectric resonators in accordance with the present invention. When using dielectric resonators in accordance with the present invention, it is possible to manufacture a filter that has high Q.

Figure 8A:
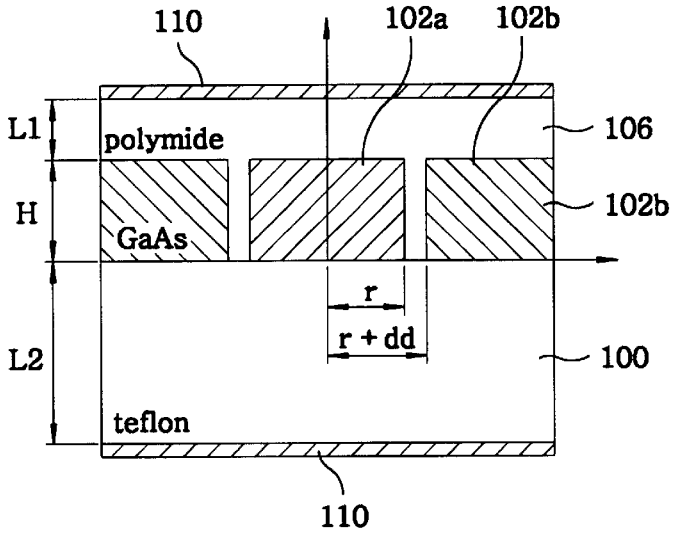
FIG. 8A illustrates a vertical cross-sectional view of a dielectric substrate resonator in accordance with the present invention for description of the resonant frequency of the dielectric resonator.
Figure 8B:
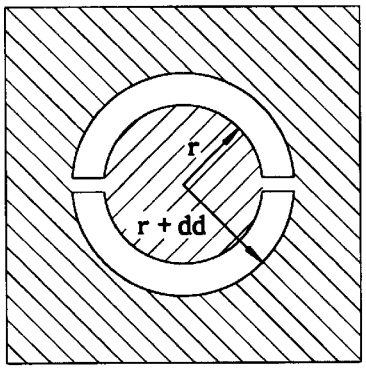
FIG. 8B illustrates a horizontal cross-sectional view of a structure of the dielectric substrate resonator shown in FIG. 8A.

For the purpose of explaining the resonant frequency of a dielectric resonator in accordance with the present invention, FIGS. 8A and 8B show cross-sectional views of the vertical and horizontal structure of the dielectric resonator. In the following, referring to FIGS. 8A and 8B, the resonant frequency of a dielectric substrate resonator in accordance with the present invention will be described in detail.

As a method for computing resonant frequencies of dielectric resonators, Itoh & Rudokas' method can be used. The Itoh & Rudokas' method, which is described in T. Itoh and R. S. Rudokas, "New Method for Computing the Resonant Frequencies of Dielectric Resonators", IEEE Transactions on Microwave Theory and Technology, MMT-25, No. 12, pp. 52–54 (January 1977), calculates the resonant frequencies under the boundary condition of each area into which a dielectric resonator is divided. The boundary condition equations according to the Itoh & Rudokas' method are expressed in Equations (4) and (5).

$$\beta H = q\pi + \tan^{-1}\left[\frac{\alpha_1}{\beta}\coth(\alpha_1 L_1)\right] + \tan^{-1}\left[\frac{\alpha_2}{\beta}\coth(\alpha_2 L_2)\right] \quad \text{Equation (4)}$$

$$\frac{J_0(k_{r1}r)}{J_1(k_{r1}r)} = -\frac{k_{r2}r}{k_{r1}r}\frac{K_0(k_{r2}r)}{K_1(k_{r2}r)} \quad \text{Equation (5)}$$

where $L_1$, is a thickness of the fluid dielectric membrane 106, $L_2$ is a thickness of the dielectric supporting substrate 100, H is a height of the dielectric resonator 102*a*, and r is a radius of the dielectric resonator 102*b*.

Figure 9A:
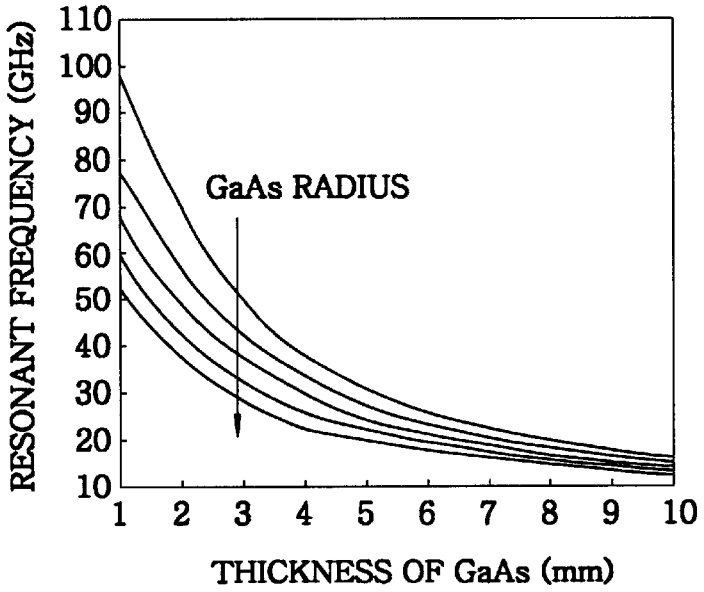
FIG. 9A exhibits a relationship between the resonant frequency and the thickness of a dielectric resonator in accordance with the present invention.
Figure 9B:
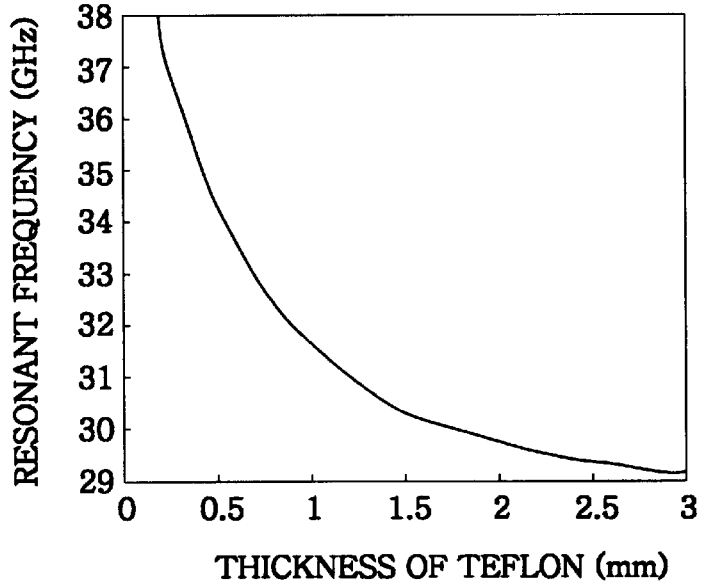
FIG. 9B exhibits a relationship between the resonant frequency. and the thickness of a dielectric supporting substrate in accordance with the present invention.
Figure 9C:
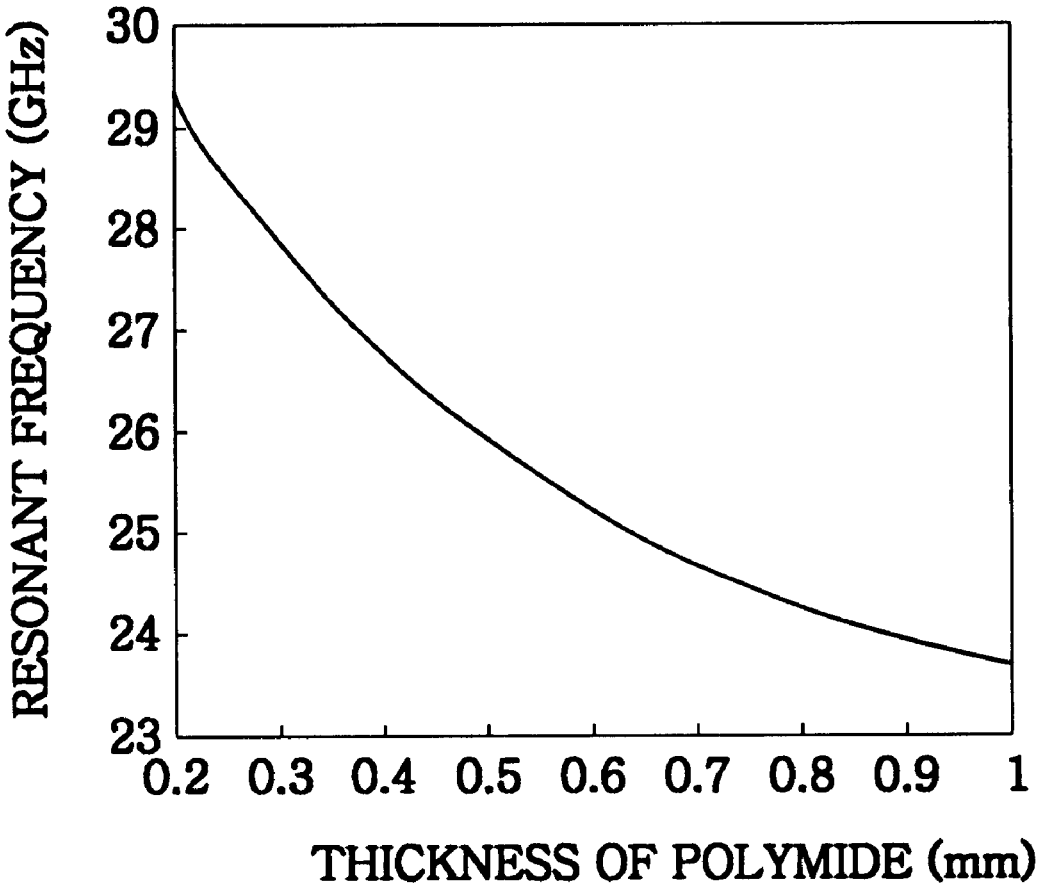
FIG. 9C exhibits a relationship between the resonant frequency and the thickness of a fluid dielectric membrane in accordance with the present invention.

The resonant frequency can be obtained by resolving Equations (4) and (5) by using numerical analysis. FIGS. 9A to 9C show the relationships of the resonant frequency with the thickness of each of the dielectric resonator 102*a*, the dielectric supporting substrate 100 and the fluid dielectric membrane 106, respectively.

FIGS. 9A to 9C show that the resonant frequency decreases as the thickness of each of the dielectric resonator 102*a* (GaAs), the dielectric supporting substrate 100 (Teflon), and the fluid dielectric membrane 106 (polymide) increases. Further, FIG. 9A illustrates that the resonant frequency decreases as the radius of the dielectric resonator 102*a* (GaAs) increases.

Therefore, the optimal resonant frequency can be obtained by adjusting the thickness of each of the dielectric resonator 102*a*, the dielectric supporting substrate 100, and the fluid dielectric membrane 106. Also, the radius of the dielectric resonator 102*a* affects the resonant frequency.

Q of the microstrip line 108 in the dielectric substrate resonator in accordance with the present invention is computed by using Equation (6).

$$\frac{1}{Q_u} = \frac{1}{Q_r} + \frac{1}{Q_c} + \frac{1}{Q_d} \approx \frac{1}{Q_c} + \frac{1}{Q_d} \quad \text{Equation (6)}$$

where $Q_u$ is an unloaded Q of the microstrip line 108, $Q_r$ is Q by radiation loss, $Q_c$ is Q by conductivity loss and $Q_d$ is Q by dielectric loss.

$Q_r$ is negligible when the dielectric substrate resonator is surrounded by a metallic wall which plays a role of ground, which means that $Q_u$ depends on $Q_c$ and $Q_d$ as shown in Equation (6). $Q_d$ is the reciprocal of the loss tangent and has a value of about 1667 when the dielectric resonator substrate 102*b* is composed of GaAs. $Q_c$ is Q by loss due to the skin depth of the microstrip line 108.

The dielectric substrate resonator in accordance with the present invention, when it is applied to a multi-layer circuit, MMIC or filter, reduces a conductivity loss of the microstrip line by lengthening the distance between the microstrip line in the lower layer and the dielectric substrate in the higher layer. Further, the dielectric substrate resonator reduces a dielectric loss of the dielectric resonator by employing the dielectric resonator substrate, which has a high dielectric permittivity, in the circumference of the dielectric resonator. According to Equation (6), the lower a conductivity loss and a dielectric loss are, the higher Q is.

Figure 10:
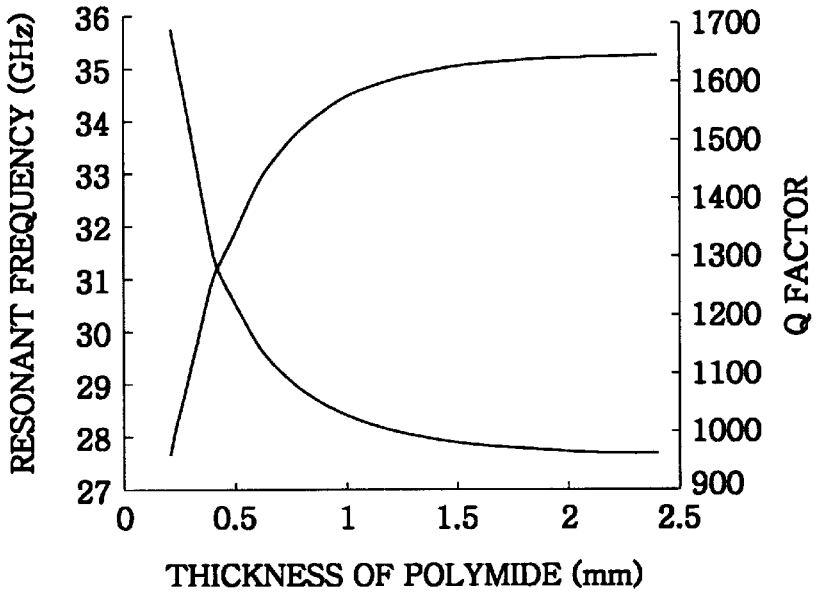
FIG. 10 depicts changes in Q and the resonant frequency as functions of the change of the thickness of a fluid dielectric membrane in accordance with the present invention.

FIG. 10 exhibits changes of the unloaded Q and the resonant frequency of the microstrip line 108 as functions of the change of the thickness of the fluid dielectric membrane 106 in accordance with the present invention. As shown in FIG. 10, $Q_u$ has the value ranging from 900 to 1000 when the thickness of polymide ranges from 0.2 mm to 0.3 mm.

Figure 11:
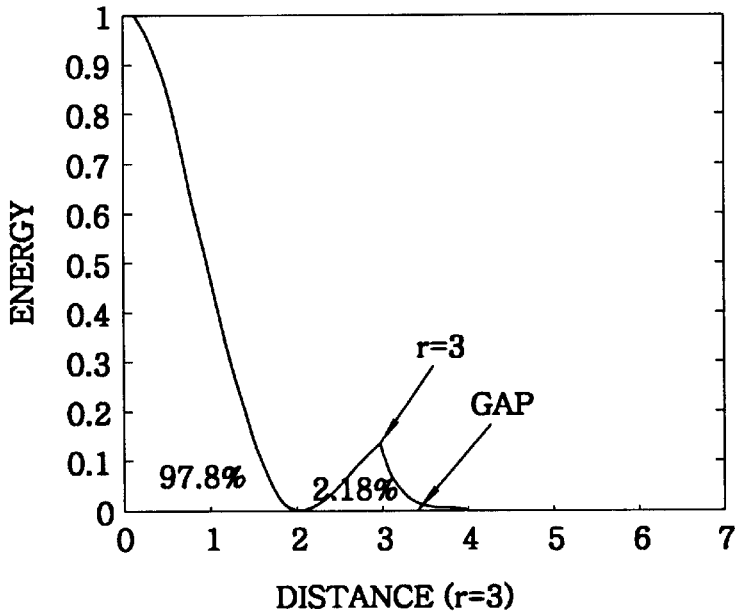
FIG. 11 depicts an energy distribution in a dielectric substrate resonator in accordance with the present invention.

FIG. 11 illustrates an energy distribution in the dielectric resonator 102*a*, the radius of which is 3 mm, in accordance with the present invention. Referring to FIG. 11, it is found that almost all of the energy is distributed within the distance of 3.5 mm from the center of the dielectric resonator 102*a*. That is, when the gap 104 between the dielectric resonator and the dielectric resonator substrate 102*b* is more than 0.5 mm, most of the energy is distributed near the dielectric resonator, which results in lower loss of energy.

Therefore, the dielectric substrate resonator in accordance with the present invention reduces the energy loss by adjusting the gap between the dielectric resonator and the dielectric resonator substrate.

Figure 12:
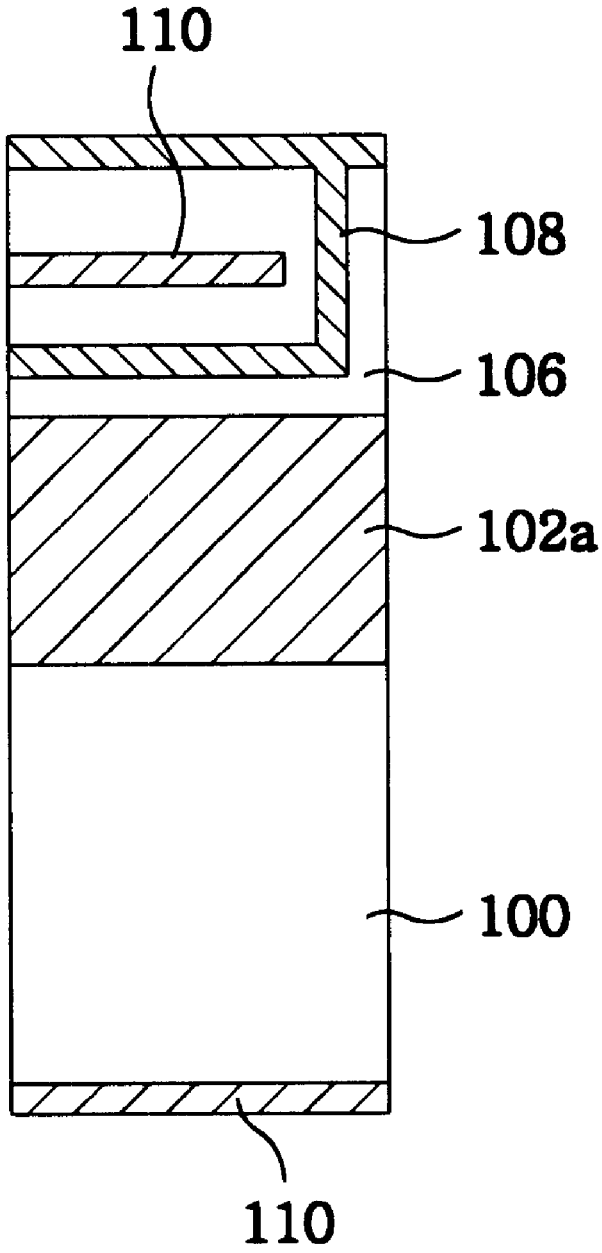
FIG. 12 charts a vertical cross-sectional view of a dielectric substrate resonator without a dielectric resonator substrate in accordance with another embodiment of the present invention.

FIG. 12 charts a vertical cross-sectional view of a dielectric resonator without a dielectric resonator substrate in accordance with another embodiment of the present invention.

As shown in FIG. 12, the dielectric resonator in accordance with the another embodiment of the present invention comprises a dielectric supporting substrate 100, a dielectric resonator 102 which has higher dielectric permittivity than that of the dielectric supporting substrate 100 and is formed thereon, a fluid dielectric membrane 106 which overspreads the dielectric resonator 102, and a microstrip line 108 which is arranged in the fluid dielectric membrane 106 so that the microstrip line 108 is coupled with the dielectric resonator 102.

The dielectric resonator without a dielectric resonator substrate in accordance with the another embodiment of the present invention has an advantage that it is used to miniaturize devices such as a filter and an oscillator.

While the invention has been shown and described with respect to the preferred embodiments, it will be understood by those skilled in the art that various changes and modifications may be made without departing from the spirit and scope of the invention as defined in the following claims.

What is claimed is:

1. A resonating apparatus comprising:

a dielectric supporting substrate;

a dielectric resonator which is formed on the dielectric supporting substrate;

a fluid dielectric membrane which overspreads the dielectric resonator; and a microstrip line which is arranged in the fluid dielectric membrane whereby the microstrip line is coupled with the dielectric resonator, wherein the dielectric resonator has a higher dielectric permittivity than the dielectric supporting substrate and the fluid dielectric membrane.

2. The apparatus of claim 1, further comprising:

a dielectric resonator substrate which surrounds the dielectric resonator so that a gap is formed therebetween, wherein the dielectric resonator substrate has the same dielectric permittivity as the dielectric resonator substrate.

3. The apparatus of claim 2, wherein the fluid dielectric membrane overspreads the dielectric resonator, the dielectric resonator substrate and the gap therebetween.

4. The apparatus of claim 1, wherein the dielectric resonator is formed in the shape of a circle or a polygon.

5. The apparatus of claim 1, further comprising:

equal to or more than one dielectric connection line which connects the dielectric resonator to the dielectric resonator substrate.

6. The apparatus of claim 1, wherein the dielectric supporting substrate, the dielectric resonator and the fluid dielectric membrane contain Teflon, GaAs and polymide, respectively.

7. The apparatus of claim 1, further comprising a ground line in each of the fluid dielectric membrane and the dielectric supporting substrate.

8. The apparatus of claim 1, wherein the microstrip line is formed in the shape of a straight line or a semicircle.

9. The apparatus of claim 2, wherein the gap is filled with air.

* * * * *